US006533551B2

(12) United States Patent
Escobar et al.

(10) Patent No.: US 6,533,551 B2
(45) Date of Patent: Mar. 18, 2003

(54) HOUSEHOLD APPARATUS

(76) Inventors: Kimmy Escobar, 250 N. Linden Ave. #81, Rialto, CA (US) 92376; Jacqueline Yepez, 250 N. Linden Ave. #81, Rialto, CA (US) 92376

( * ) Notice: Subject to any disclaimer, the term of this patent is extended or adjusted under 35 U.S.C. 154(b) by 0 days.

(21) Appl. No.: 09/961,124

(22) Filed: Sep. 20, 2001

(65) Prior Publication Data

US 2002/0034442 A1 Mar. 21, 2002

Related U.S. Application Data

(60) Provisional application No. 60/233,900, filed on Sep. 20, 2000.

(51) Int. Cl.[7] ..... F04D 29/38
(52) U.S. Cl. ..... 416/244 R
(58) Field of Search ..... 416/100, 61, 244 R, 416/246

(56) References Cited

U.S. PATENT DOCUMENTS

| | | | | |
|---|---|---|---|---|
| 4,768,926 A | | 9/1988 | Gilbert, Jr. | |
| 5,189,412 A | * | 2/1993 | Mehta et al. | 340/825.22 |
| 5,256,039 A | | 10/1993 | Crawford | |
| 5,720,594 A | | 2/1998 | Snow | |
| 6,283,709 B1 | * | 9/2001 | Hill et al. | 416/110 |

* cited by examiner

*Primary Examiner*—Edward K. Look
*Assistant Examiner*—Dwayne J. White
(74) *Attorney, Agent, or Firm*—Matthew J. Peirce

(57) ABSTRACT

A new and improved fan is disclosed which can be operated by a remote control. The concept of the present invention can be applied to any design fan, either a table top or floor fan, and would provide features such as tilt, level, pause and sleep remote functions. The remote control itself could come in a wide variety of designs.

12 Claims, 1 Drawing Sheet

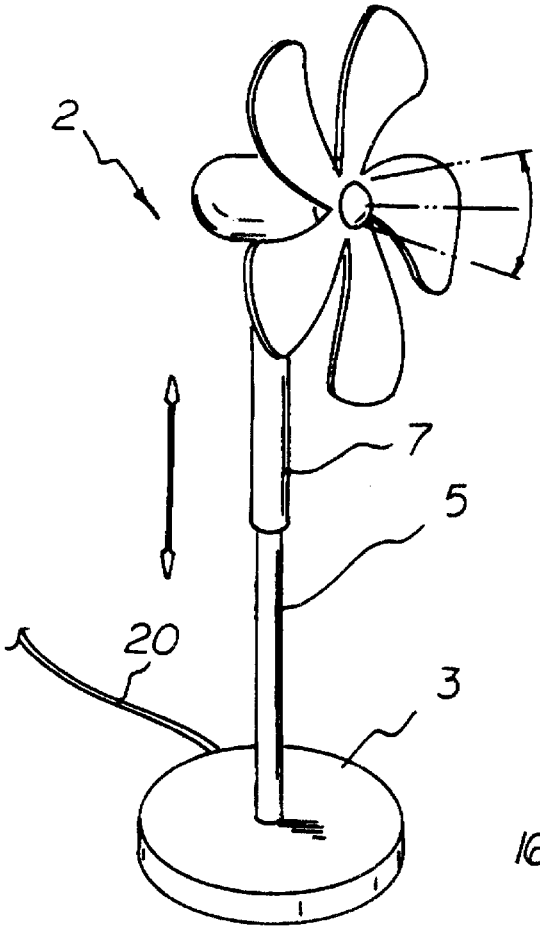
FIG 1
FIG 2
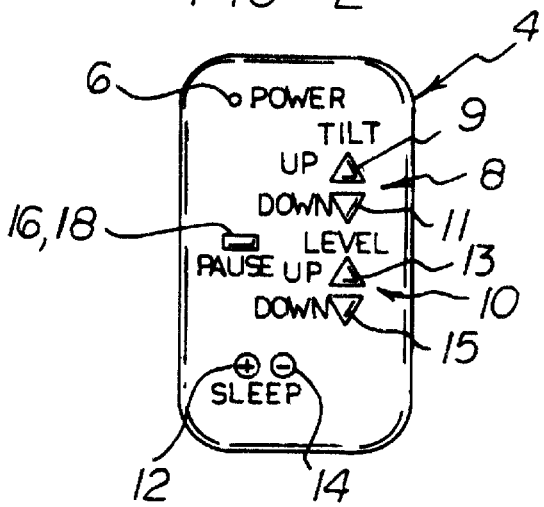
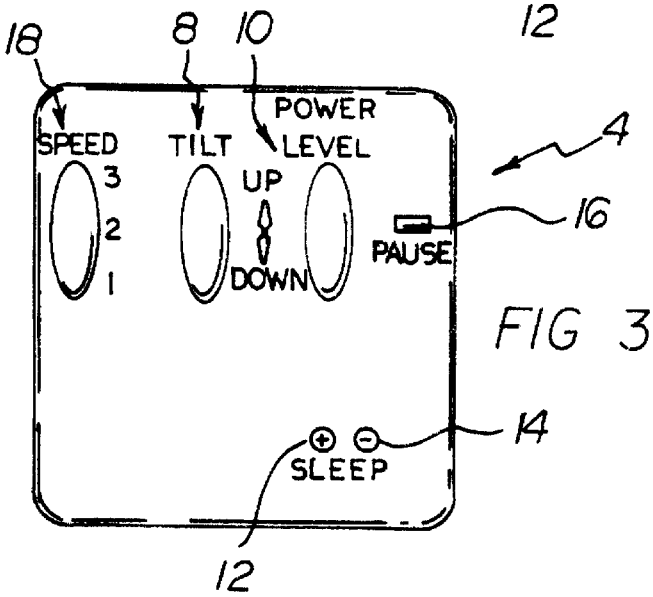
FIG 3

HOUSEHOLD APPARATUS

This application claims the benefit of Provisional Application No. 60/233,900 filed Sep. 20, 2000.

I. BACKGROUND OF THE INVENTION

The present invention is that of a new and improved fan which can be operated by a remote control.

II. DESCRIPTION OF THE PRIOR ART

U.S. Pat. No. 5,720,594, issued to Snow, discloses a portable fan which provides oscillation in two axes.

U.S. Pat. No. 5,256,039, issued to Crawford, discloses a remote controlled fan which is operated by a hand held remote control which controls the power, speed of fan rotation, oscillation of the fan, and movement of the fan.

U.S. Pat. No. 4,768,926, issued to Gilbert, Jr., discloses a portable fan which is provided with a remote control assembly to facilitate its use by handicapped persons.

III. SUMMARY OF THE INVENTION

The present invention is that of a new and improved fan which can be operated by a remote control. The concept of the present invention can be applied to any design fan, either a table top or floor fan, and would provide features such as tilt, level, pause and sleep remote functions. The remote control itself could come in a wide variety of designs.

There has thus been outlined, rather broadly, the more important features of a fan in order that the detailed description thereof that follows may be better understood and in order that the present contribution to the art may be better appreciated. There are, of course, additional features of the fan that will be described hereinafter and which will form the subject matter of the claims appended hereto.

In this respect, before explaining at least one embodiment of the fan in detail, it is to be understood that the fan is not limited in its application to the details of construction and to the arrangements of the components set forth in the following description or illustrated in the drawings. The fan is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present fan. It is important, therefore, that the claims be regard as including such equivalent constructions insofar as they do not depart from the spirit and scope of the present invention.

It is therefore an object of the present invention to provide a fan which has all of the advantages of the prior art and none of the disadvantages.

It is another object of the present invention to provide a fan which may be easily and efficiently manufactured and marketed.

It is another object of the present invention to provide a fan which is of durable and reliable construction.

It is yet another object of the present invention to provide a fan which is economically affordable and available to the buying public.

It is yet another object of the present invention to provide a fan which provides additional benefits not present in the prior art.

Other objects, features and advantages of the present invention will become more readily apparent from the following detailed description of the preferred embodiment when considered with the attached drawings and appended claims.

IV. BRIEF DESCRIPTION OF THE DRAWINGS

FIG. 1 shows a perspective view of a fan of the present invention as a floor fan.

FIGS. 2 and 3 show front views of possible remote controls used with the present invention.

V. DESCRIPTION OF THE PREFERRED EMBODIMENT

FIG. 1 shows a perspective view of a fan 2 of the present invention. The present invention is that of a new and improved fan which can be operated by a remote control 4. The concept of the present invention can be applied to any design fan, either a table top or floor fan, and would provide features such as tilt, level, pause and sleep remote functions. The remote control 4 itself could come in a wide variety of designs.

Fan 2 is shown in FIG. 1 as a floor fan and is located on base 3 and stand 5. Fan 2 itself would be attached to tube 7, which would be located on top of stand 5 and would traverse up and down on top of stand 5, depending on an individual user's preference. Base 3 would preferably be a base of enough surface area to ensure that fan 2 would be properly supported and not tip over while in use. Fan 2 would likely be powered by standard household current via power cord 20 and would also have a receiver incorporated into it to receive radio waves from the remote control 4 that would come with the fan 2.

FIGS. 2 and 3 show front views of possible remote controls 4 used with the present invention. Each remote control 4 would have a power button 6 and could also include one or more of the following: a tilt control 8, a level control 10, sleep programming buttons 12 and 14, a pause button 16, and/or a speed control 18.

In FIG. 2, tilt control 8 comprises two buttons which include an "up" button 9 and a "down" button 11. The tilt control 8 would allow a user to choose the angle at which the fan head would face when fan 2 would be in operation. Further, level control 10 comprises two buttons which comprise an "up" button 13 and a "down" button 15. The level control 10 would allow a user to choose the height at which the fan head would be located when fan 2 would be in operation.

FIG. 3 shows an alternative variation of the remote control 4. Included in this alternative variation are tilt control 8, level control 10, sleep programming buttons 12 and 14, a pause button 16, and/or a speed control 18. This remote control 4 is different, however, as tilt control 8, a level control 10, and speed control 18 are actually long oval buttons. Each control button can be used to completely control each function, because a user need only push on opposite sides of each button to get opposite results.

Sleep programming buttons 12 and 14 in FIGS. 2 and 3 can be used to turn on or off the sleep programming functions of the present invention. In addition, pause button 16 can be used by a user to temporarily pause the functions of fan 2 from operating. If a user would push pause button 16 a second time, then the operations of fan 2 would start again.

Remote control 4, in whatever form, would also have a transmitter 26 which would emit radio waves of a specific wavelength whenever a button would be pressed on the remote control 4. The waves emitted from the transmitter 26 would be picked up by the receiver on the fan 2. Remote control 4 would also have an incorporated power means, which would preferably be at least one battery. The battery would be located in a battery compartment within the remote control 4.

What I claim as my invention is:

1. A household apparatus comprising:

(a) a fan unit, the fan unit including a base, the fan unit further including a stand mounted on the base, the fan unit further including a fan mounted on the stand, the fan designed to face outward at a specific angle relative to a ground surface, and the fan unit further including a receiver, (b) power means to provide power to the fan unit, and (c) a remote control having a front face and a rear face, the remote control also including a plurality of buttons located on the front face of the remote control, the plurality of buttons including a power button, a tilt control button, a level control button, a steep timer button, a pause button, and a speed control button, the remote control also including a transmitter to emit radio waves when one or more buttons would be pressed, the remote control further including power means to provide power to the remote control.

2. A household apparatus according to claim 1 wherein the height of the stand would be adjustable.

3. A household apparatus according to claim 1 wherein the fan would be capable of being set at different outward angles relative to a ground surface.

4. A household apparatus according to claim 1 wherein the fan would be capable of operating at different speeds.

5. A household apparatus according to claim 1 wherein the fan unit would be a table fan.

6. A household apparatus according to claim 1 wherein the fan unit would be a floor fan.

7. A household apparatus according to claim 1 wherein the power button on the remote control would alternatively turn on and turn off the fan unit.

8. A household apparatus according to claim 1 wherein the tilt control button on the remote control would alter the outward angle of the fan relative to a ground surface.

9. A household apparatus according to claim 1 wherein the level control button on the remote control would alter the height of the stand.

10. A household apparatus according to claim 1 wherein the sleep control button on the remote control would program the fan unit to turn off after a specified amount of time.

11. A household apparatus according to claim 1 wherein the pause button on the remote control would alternatively turn on and turn off the fan unit.

12. A household apparatus according to claim 1 wherein the speed control button on the remote control would change the specific speed at which the fan would be rotating.

* * * * *